US006382925B1

(12) United States Patent
Oba et al.

(10) Patent No.: US 6,382,925 B1
(45) Date of Patent: May 7, 2002

(54) VARIABLE DISPLACEMENT PUMP

(75) Inventors: Kenzo Oba; Morihito Ichizuki; Kenji Saito, all of Haga-gun (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 09/620,120

(22) Filed: Jul. 20, 2000

(30) Foreign Application Priority Data

Jul. 21, 1999 (JP) ..... 11-206488

(51) Int. Cl.[7] ..... F04B 49/00
(52) U.S. Cl. ..... 417/220; 417/310; 418/16
(58) Field of Search ..... 417/220, 310, 417/559; 418/24, 25, 26, 27, 30, 16

(56) References Cited

U.S. PATENT DOCUMENTS 5,538,400 A * 7/1996 Konishi et al. ..... 417/220
5,863,189 A * 1/1999 Sundberg et al. ..... 418/16
6,042,343 A * 3/2000 Semba et al. ..... 417/220

FOREIGN PATENT DOCUMENTS

JP 59196987 8/1984
JP 59196987 A * 11/1984 ..... 418/26
JP 03275990 A * 12/1991 ..... 418/30
JP 06093978 A * 4/1994 ..... 418/30
JP 8200239 6/1996
JP 08200239 A * 6/1996 ..... 418/16

* cited by examiner

*Primary Examiner*—Charles G. Freay
*Assistant Examiner*—Han Lieh Liu
(74) *Attorney, Agent, or Firm*—Orun & Roth

(57) ABSTRACT

In a variable displacement pump for a power steering device of a vehicle, the adapter ring is arranged to be easily engaged with the engagement hole at the pump casing, to improve ease of assembly. The relationship of the adapter ring with the engagement hole reduces vibration and noise. Also, the reduction and deformation qualities of the adapter ring are increased

8 Claims, 4 Drawing Sheets

VARIABLE DISPLACEMENT PUMP

BACKGROUND OF THE INVENTION

1. Field of the Invention

The present invention relates to a variable displacement pump employed for a power steering device or the like of a vehicle.

2. Description of the Related Art

A variable displacement pump is disclosed in Japanese Patent Application Laid-open (JP-A) No. 8-200239, to assist steering force by means of a hydraulic power steering device for a vehicle. This conventional variable displacement pump is directly rotated and driven by means of an engine of the vehicle. A rotor is provided in a cam ring engaged movably and displaceably with an adapter ring engaged with a pump casing, and forms a pump chamber between the cam ring and the periphery of the rotor.

In this conventional technology, there is provided an ejection flow rate control device in which the cam ring is movable and displaceable in the adapter ring. Biasing force is imparted to the cam ring by a spring such that a capacitance of the pump chamber is maximized. First and second fluid pressure chambers are formed to be divided between the cam ring and the adapter ring. The cam ring is moved against the biasing force by a differential pressure acting to both of the fluid pressure chambers. The capacitance of the pump chamber is changed, thereby making it possible to control an ejection flow rate. In this manner, in this variable displacement pump, the ejection-flow rate is increased so that a large steering assistance force can be obtained during stoppage or low-speed running of a vehicle with its low rotation frequency. The ejection flow rate is controlled to a predetermined quantity so that the steering assistance force is reduced during high-speed running with its high rotation frequency, whereby the steering assistance force required for the power steering device can be generated.

Hence, in the conventional technology, the adapter ring is annular. When this adapter ring is engaged with the pump casing, the adapter ring is thin, and thus, it cannot be pressed-in. Therefore, the adapter ring is forced to have a slight gap between the adapter ring and the pump casing during engagement with the pump casing. The presence of this gap causes unwanted vibration of the adapter ring during pump actuation, and causes abnormal noise to be generated.

SUMMARY OF THE INVENTION

It is an object of the present invention to reduce in a variable displacement pump the generation of vibration and abnormal noise of the adapter ring during pump actuation while the assembling properties of engagement of the adapter ring with the pump casing is improved in a variable displacement pump.

According to the present invention, there is disclosed a variable displacement pump comprising:

- a rotor fixed to a pump shaft inserted into a pump casing to be rotatably driven, the rotor housing a number of vanes in grooves and being movable in a radial direction;
- an adapter ring engaged with an engagement hole of the pump casing;
- a cam ring engaged with the adapter ring and forming a pump chamber between the cam ring and the periphery of the rotor;
- an ejection flow rate control device making it possible to move and displace the cam ring in the adapter ring, imparting to the cam ring a biasing force such that the capacitance of a pump chamber is maximized, forming first and second fluid pressure chambers to be divided between the cam ring and the adapter ring, moving the cam ring against said biasing force with a differential pressure acting to both of the fluid pressure chambers, and changing the capacitance of the pump chamber, thereby making it possible to control an ejection flow rate.

A slit is provided over the widthwise area for the adapter ring partially in the peripheral direction of said adapter ring. The outer diameter in a free state of the adapter ring is greater than a hole diameter of an engagement hole of said pump casing, and the adapter ring is engaged with the pump casing while resilient diameter expandability is imparted to the adapter ring to bring it into close contact with the engagement hole.

BRIEF DESCRIPTION OF THE DRAWINGS

The present invention will be more filly understood from the detailed description given below and from the accompanying drawings which should not be taken to be a limitation on the invention, but are for explanation and understanding only.

The drawings

DESCRIPTION OF THE PREFERRED EMBODIMENTS

Figure 1:
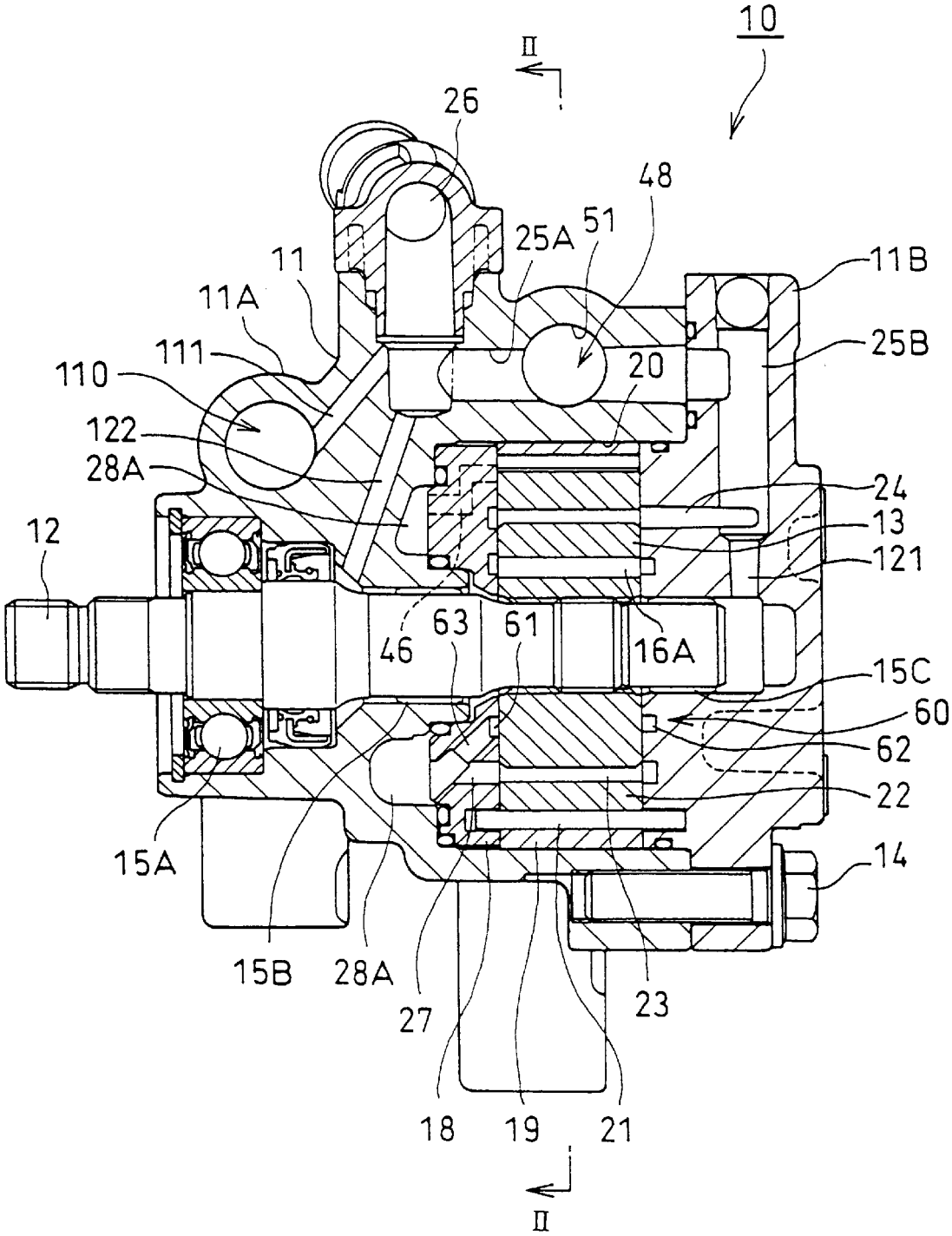
FIG. 1 is a sectional view showing a variable displacement pump.
Figure 2:
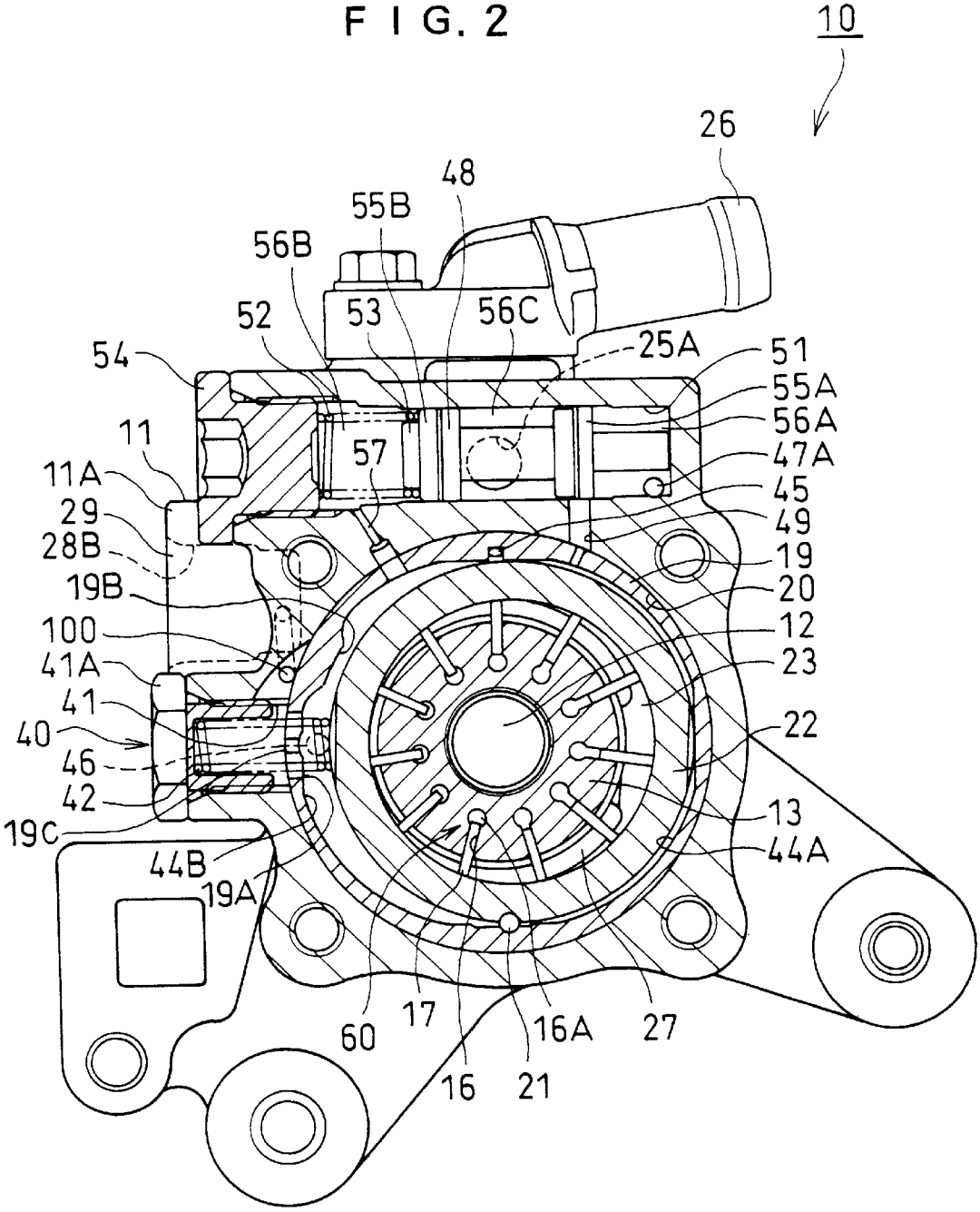
FIG. 2 is a sectional view taken along line II—I of FIG. 1.

A variable displacement pump 10 is a vane pump that is a hydraulic power generation source of a hydraulic power steering device of a vehicle. As shown in FIG. 1 and FIG. 2, the pump 10 includes a rotor 13 fixed to a pump shaft 12 inserted into a pump casing 11 by means of a serration to be rotatably driven. The pump casing 11 is arranged so as to integrate a pump housing 11A with a cover 11B by means of a bolt 14 and to support the pump shaft 12 via bearings 15A to 15C. The pump shaft 12 can be directly driven rotatably by means of a vehicle engine.

The rotor 13 houses vanes 17 in grooves 16 provided at a plurality of peripheral positions, respectively, thereby making it possible to move each vane 17 in a radial direction along the groove 16.

A pressure plate 18 and an adapter ring 19 are engaged with an engagement hole 20 of the pump housing 11A of the pump casing 11 in a layered state. The plate 18 and ring 19 are fixed laterally by a cover 11B while they are positioned in the peripheral direction by means of a fulcrum pin 21 described later.

A cam ring 22 is engaged with the aforementioned adapter ring 19 fixed to the pump casing 11. The cam ring 22 surrounds the rotor 13 with a certain quantity of eccentricity, and forms a pump chamber 23 between the pressure plate 18 and the cover 11B or the periphery of the rotor 13. On the upstream side in the rotor rotation direction of the pump chamber 23, a suction port 24 provided at the cover 1 1B opens. A suction opening 26 of the pump 10 is communicated with this suction port 24 via suction passages 25A and 25B provided at the housings 11A and 11B. On the other hand, on the downstream side of the rotor rotation direction of the pump chamber 23, an ejection port 27 provided at a pressure plate 18 opens. An ejection opening 29 of the pump 10 is communicated with this ejection port 27 via a high pressure chamber 28A and an ejection passage 28B provided at the housing 11A.

In this manner, in the variable displacement pump 10, when the rotor 13 is rotatably driven by means of the pump shaft 12, and the vane 17 of the rotor 13 rotates while it is pressed to the cam ring 22 with centrifugation force, a capacitance between an interval of the adjacent vanes 17 and the cam ring 22 is expanded together with rotation on the downstream side in the rotor rotation direction of the pump chamber 23. Then, a working fluid is suctioned from the suction port 24, the capacitance between the interval of the adjacent vanes 17 and the cam ring 22 is reduced together with rotation on the upstream side in the rotor rotation direction of the pump chamber 23, and the working fluid is ejected from the ejection port 27.

Hence, the variable displacement pump 10 has an ejection flow rate control device 40 as shown in (A) below and a vane pressurizing device 60 as shown in (B) below.

(A) Ejection flow rate control device 40

An ejection flow rate control device 40 sets the aforementioned fulcrum pin 21 at the vertical bottom of the aforementioned adapter ring 19 fixed to the pump casing 11, and supports the vertical lowermost portion of the cam ring 22 to this fulcrum pin 21, thereby making it possible to vibrate and displace the cam ring 22 in the adapter ring 19.

The ejection flow rate control device 40 causes a spring 42 housed in a spring chamber 41 provided at the pump housing 11A constituting the pump casing 11 to pass through a spring hole 19A provided at the adapter ring 19 to bring the spring into pressure contact with the periphery of the cam ring 22, whereby biasing force can be imparted to the cam ring 22 such that the capacitance of the pump chamber 23 is maximized. The spring 42 is backed up by a cap 41A spirally mounted to an opening of the spring chamber 41. The adapter ring 19 causes a cam ring movement restriction stopper 19B to be protruded partially at an inner periphery forming a second fluid pressure chamber 44B described later, thereby making it possible to restrict the movement limit of the cam ring 22 that minimizes the capacitance of the pump chamber 23 described later.

In addition, the ejection flow rate control device 40 forms first and second fluid pressure chambers 44A and 44B to be divided between the cam ring 22 and the adapter ring 19. That is, the first fluid pressure chamber 44A and the second fluid pressure chamber 44B are divided between the cam ring 22 and the adapter ring 19 by the fulcrum pin 21 and a sealing material 45 provided at the symmetrical position thereof.

Here, in the ejection passage of the aforementioned pump 10, the pressure fluid ejected from the pump chamber 23 and fed from an ejection port 27 of the pressure plate 18 to a high pressure chamber 28A of the pump housing 11A is pressure-fed to the ejection passage 28B via the aforementioned second fluid pressure chamber 44B from an orifice 46 punched at the pressure plate 18, the aforementioned spring chamber 41 passing through the adapter ring 19, and an ejection communication hole 100 formed to be cutout in the engagement hole 20 of the pump housing 11A.

In the aforementioned ejection passage of the pump 10, the ejection flow rate control device 40 increases or decreases an opening area for an orifice 46 opening at the second fluid pressure chamber 44B on the side wall of the cam ring 22, thereby forming a variable metering orifice. That is, the orifice 46 is adjusted with respect to a degree of opening on its side wall together with the movement displacement of the cam ring 22. The ejection flow rate control device 40 (1) guides a high flow pressure before passing through the orifice 46 to the first fluid pressure chamber 44A via a first fluid pressure supply passage 47A, a switching valve 48, the pump housing 11A and a communication passage 49 punched at the adapter ring 19; and (2) guides a pressure-reducing pressure after passing through the orifice 46 to the second fluid pressure chamber 44B as described previously. Then, the control device 40 moves the cam ring 22 against the biasing force of the aforementioned spring 42 with the differential pressure acting to both of the fluid pressure chambers 44A and 44B, changing the capacitance of the pump chamber 23, thereby making it possible to control the ejection flow rate of the pump 10.

A switching valve 48 houses a spring 52 and a switching plunger 53 into a valve storage hole 51 punched at a front casing 11A, and carries the plunger 53 biased by the spring 52 by means of a cap 54 spirally mounted to the casing 11A. The switching plunger 53 comprises a switching valve body 55A and a valve body 55B, communicates a first fluid pressure supply passage 47A with a pressurization chamber 56A of the switching valve body 55A, and communicates a second fluid pressure chamber 44B with a back pressure chamber 56B having another spring 52 of the valve body 55B stored therein via the pump housing 11A and a communication passage 57 punched at the adapter ring 19. In addition, the suction passage 25A is formed to pass through an intermediate chamber 56C between the switching valve 55A and the valve body 55B, and the suction side fluid is fed. The switching body 55A can open or close the aforementioned communication passage 49 punched at the pump housing 11A and the adapter ring 19. That is, in a low rotation area where the ejection pressure of the pump 10 is low, the switching plunger 53 is set at the original position shown in FIG. 1 by means of the biasing force of the spring 52 to close the communication passage 49 with the first fluid pressure chamber 44A by means of the switching valve body 55A. In middle and high rotation areas for the pump 10, the switching plunger 53 is moved by means of the high pressure fluid applied to the pressurization chamber 56 to open the communication passage 49, thereby making it possible to guide this high pressure fluid to the first fluid pressure chamber 44A.

Therefore, the ejection flow rate characteristics of the pump 10 comprising the ejection flow rate control device 40 are as follows:

(1) In a low speed running area in which the rotation frequency of the pump 10 is low, the pressure of fluid ejected from the pump chamber 23 to the pressurization chamber 56A of the switching valve 48 is low, the switching valve 48 is positioned at the original position, and the cam ring 22 maintains the original state biased by means of the spring 42. Therefore, the ejection flow rate of the pump 10 increases in proportion to the rotation frequency.

(2) When the pressure of the fluid ejected from the pump chamber 23 to the pressurization chamber 56A of the switching valve 48 is increased with an increase in rotation frequency of the pump 10, the switching 48 moves the switching plunger 53 against the biasing force of the spring 52 to open the communication passage 49, and guides this high pressure fluid to the first fluid passage chamber 44A. In this manner, the cam ring 22 is moved by the differential pressure acting to the first fluid pressure chamber 44A and the second fluid pressure chamber 44B, thereby gradually reducing the capacitance of the pump chamber 23.

Therefore, the ejection flow rate of the pump 10 offsets a flow rate increment due to an increase in rotation frequency and a flow rate decrement due to the capacitance reduction of the pump chamber 23 relevant to the increase in rotation frequency, whereby a predetermined large flow rate can be maintained.

(3) The rotation frequency of the pump 10 further increases continuously, and the cam ring 22 is further moved, whereby if the cam ring 22 is moved to be pushed over the spring 42 by a predetermined quantity, the side wall of this cam ring 22 starts collimating the opening area for the orifice 46 at the intermediate part of an ejection passage from the pump chamber 23. Therefore, the ejection flow rate of the pump 10 is reduced in proportion to the collimating quantity of this orifice 46.

(4) When the rotation frequency of the pump 10 reaches a high speed driving area for a vehicle in excess of a predetermined value, the cam ring 22 reaches a movement limit impinging on a stopper 19B of the adapter ring 19. Then, the collimating quantity of the orifice 46 is maximized by means of the side wall of the cam ring 22, and the ejection flow rate of the pump 10 maintains a predetermined small flow rate.

(B) Vane pressurization device 60

A vane pressurization device 60 provides ring shaped oil grooves 61 and 62 on a slide contact face with a groove 16 of a pressure plate 18 and a side plate 20 corresponding to both sides of a proximal portion 16A of a groove 16 housing a vane 17 of the rotor 13. The high pressure chamber 28A of the pump chamber 23 provided at the pump housing 11A is communicated with the aforementioned oil groove 61 via an oil hole 63 provided at the pressure plate 18. In this manner, the pressure fluid ejected from the pump chamber 23 to the high pressure chamber 28A is guided to the proximal portion of the groove 16 for all the vanes 17 in the peripheral direction of the rotor 13 via the oil grooves 61 and 62 of the pressure plate 18 and a side plate 20, thereby making it possible to pressurize each vane 17 toward the cam ring 22.

In this manner, in the pump 10, although the vane 17 is pressed against the cam ring 22 at the start of rotation with a centrifugation force, the contact pressure between the vane 17 and the cam ring 22 is increased by means of a vane pressurizing device 60 after the ejection pressure has been generated, thereby making it possible to prevent back flow of the pressure fluid.

Figure 3A:
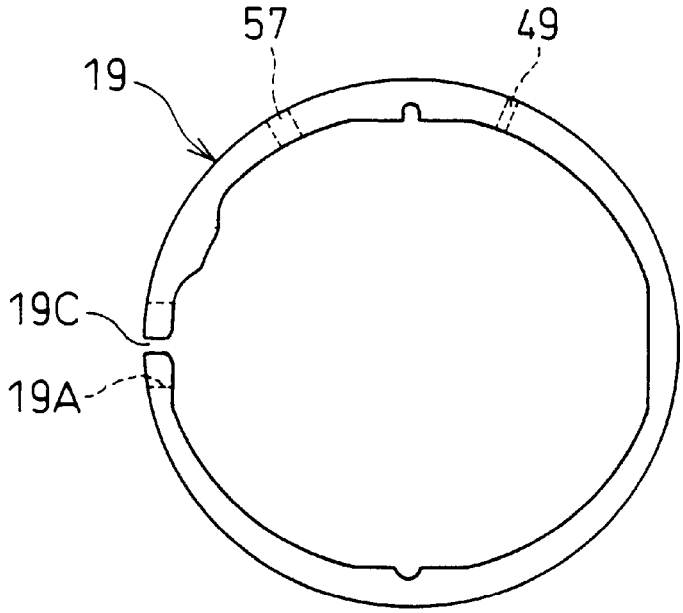
FIG. 3 is a schematic view showing an adapter ring.
Figure 3B:
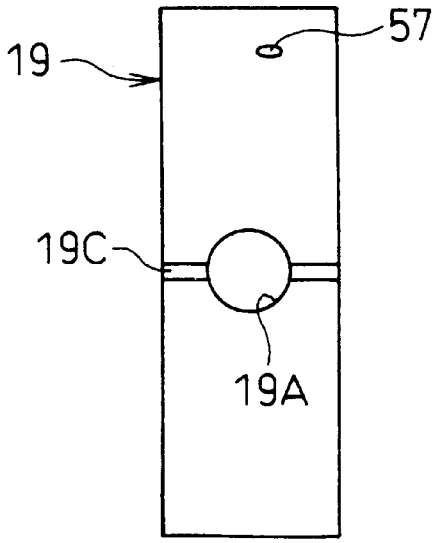

Hence, in the pump 10, as shown in FIG. 2 and FIG. 3, a slit 19C over the widthwise direction of the adapter ring 19 is provided partially in the peripheral direction of the foregoing adapter ring 19. At this time, in the adapter ring 19, its outer diameter is set to be greater than the hole diameter of the engagement hole 20 in a free state before being engagingly mounted to the engagement hole 20 of the pump housing 11A. Then, the adapter ring 19 is engaged with the engagement hole 20 in a state in which resilient diameter expandability is imparted such that the adapter ring 19 can come into close contact with the engagement hole 20 from a resilient diameter reduction and deformation state equal to or smaller than the hole diameter of the engagement hole 20 of the pump housing 11A. That is, the adapter ring 19 is engaged with the engagement hole 20 by imparting the resilient diameter reduction and deformation state. In the engagement completion state, the adapter ring 19 resiliently expands in diameter from its resilient diameter reduction and deformation state. Then, the adapter ring 19 is brought into close contact with the engagement hole 20 in a state in which the ring 19 comes into resilient pressure contact with the engagement hole 20 (in a press-in state).

At this time, in the adapter ring 19, a slit 19C may be provided in any peripheral direction. For example, the slit 19C may be provided at an opposite position of the diameter direction relevant to a spring hole 19A for the aforementioned spring 42. However, in the illustrative embodiment, the slit 19C is provided at a position crossing the spring hole 19A.

In the pump housing 11 of the pump 10, a relief valve 110 and a relief passage 111 are provided between an ejection passage 28B and a suction passage 25A, making it possible to relieve the ejection pressure of the pump 10. In addition, in the cover 11B of the pump 10, a lubricating oil supply passage 121 is punched from the suction passage 25B around a bearing 15C of the pump shaft 12. In the pump housing 11A, a lubricating oil return passage 122 that returns oil from the periphery of the bearing 15B of the pump shaft 12 to the suction passage 25A is punched.

Therefore, according to the illustrative embodiment, the following effects are achieved.

(1) In the adapter ring 19, the resilient diameter reduction and deformation state caused by the presence of the slit 19C is imparted when the adapter ring 19 is engaged with the pump casing 11 to be assembled. Then, the adapter ring 19 is easily engaged with the engagement hole 20 of the pump casing 11, thereby making it possible to improve engagement assembling properties.

(2) In the adapter ring 19, resilient diameter expandability is imparted such that the adapter ring 19 comes into close contact with the engagement hole 20 of the pump casing 11 after the ring 19 has been engaged with the pump casing 11 to be assembled. Therefore, the adapter ring 19 comes into close contact with the engagement hole 20 without providing a gap between the ring 19 and the pump casing 11 during engagement with the pump casing 11, thereby making it possible to reduce the generation of vibration and abnormal noise of the adapter ring 19 when the pump 10 is actuated.

Figure 4:
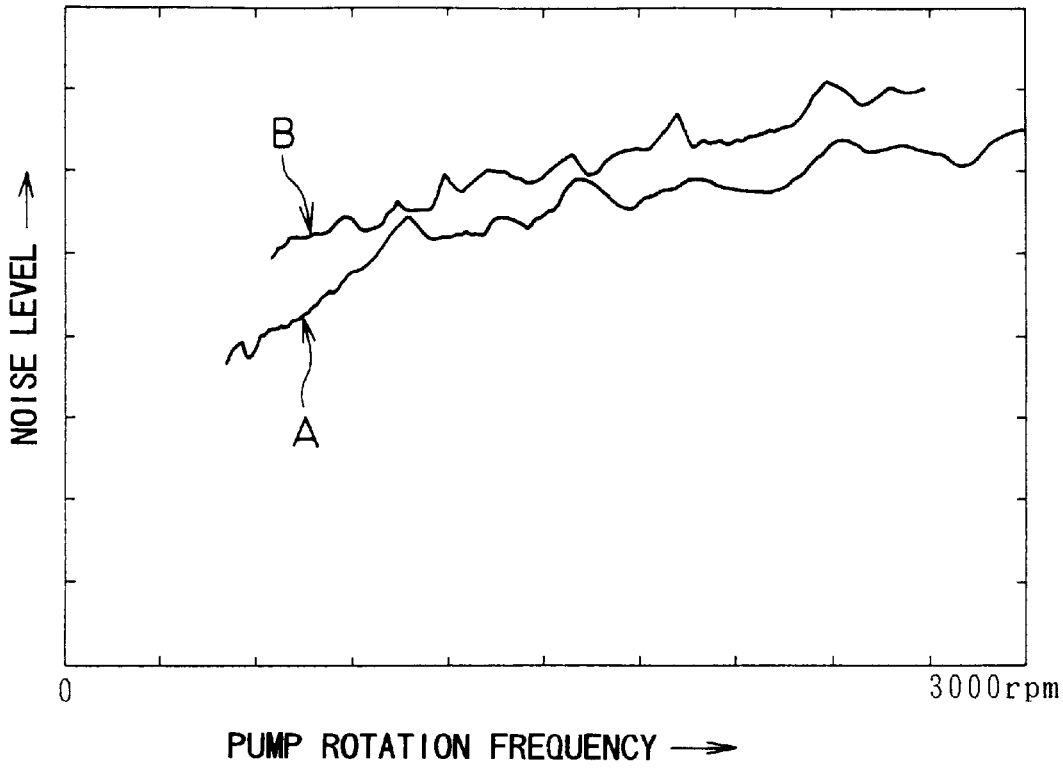
FIG. 4 is a wiring diagram showing a noise level of a pump.

FIG. 4 is a wiring diagram showing noise level A of the pump 10 to which the present invention has been applied; and noise level B of the conventional pump, wherein the generation of an abnormal noise can be reduced by embodying the present invention.

(3) When the adapter ring 19 is provided with the spring hole 19A, the ring 19 is constructed so that the slit 19C of the aforementioned (1) is provided at a position crossing the spring hole 19A, i.e., at a position coincident with the spring hole 19A. Thus, in comparing a case where the slit 19C is provided at a position different from the spring hole 19A, can be eliminated a danger that a low strength portion is bent and damaged due to the provision of the spring hole 19A of the adapter ring 19 when the adapter ring 19 is resiliently reduced in diameter and is deformed as described in the aforementioned (1) can be eliminated, and there can be eliminated can be improved its engagement assembling property can be improved such that the diameter reduction and deformation quantity of the aforementioned (1) of the adapter ring 19 can be increased.

As heretofore explained, embodiments of the present invention have been described in detail with reference to the drawings. However, the specific configurations of the present invention are not limited to the embodiments but those having a modification of the design within the range of the present invention are also included in the present invention.

As has been described above, according to the present invention, in the variable displacement pump, the generation of vibration or abnormal noise of the adapter ring can be reduced during pump actuation while the assembling properties of the adapter ring engaged with the pump casing are improved.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A variable displacement pump comprising:

a rotor fixed to a pump shaft inserted into a pump casing to be rotatably driven, the rotor housing a number of vanes in grooves and being movable in a radial direction;

an adapter ring engaged with an engagement hole of the pump casing;

a cam ring engaged with the adapter ring and forming a pump chamber between the cam ring and the periphery of the rotor;

an ejection flow rate control device allowing movement and displacement of the cam ring in the adapter ring, imparting to the cam ring biasing force such that the capacitance of a pump chamber is maximized, forming first and second fluid pressure chamber to be divided between the cam ring and the adapter ring, moving the cam ring against said biasing force with a differential pressure of pressures acting to both of the fluid pressure chambers, and changing the capacitance of the pump chamber, thereby making it possible to control an ejection flow rate, wherein a slit provided all through a width in the axial direction of the adapter ring, and also through a thickness that crosses through said width of the adapter ring, is provided partially in the peripheral direction of said adapter ring, the outer diameter in a free state of the adapter ring being greater than a hole diameter of an engagement hole of said pump casing, the adapter ring being engaged with the pump casing while resilient diameter expandability is imparted to the adapter ring to facilitate close contact with the engagement hole.

2. A variable displacement pump according to claim 1, wherein a spring housed in a spring chamber provided in said pump casing is passed through a spring hole provided at the adapter ring, and is brought into pressure contact with the cam ring, thereby imparting said biasing force to the cam ring, and said slit provided at the adapter ring is adapted to cross said spring hole.

3. A variable displacement pump according to claim 1, wherein a communication passage for passing the ejection fluid of a pump into a first fluid pressure chamber or a second fluid pressure chamber is provided at said adapter ring.

4. A variable displacement pump according to claim 2, wherein a communication passage for passing the ejection fluid of a pump into a first fluid pressure chamber or a second fluid pressure chamber is provided at said adapter ring.

5. A variable displacement pump according to claim 1, wherein said adapter ring has a cam ring movement restriction stopper formed to be protruded partially at the inner periphery forming said first fluid pressure chamber or said second fluid pressure chamber.

6. A variable displacement pump according to claim 2, wherein said adapter ring has a cam ring movement restriction stopper formed to be protruded partially at the inner periphery forming said first fluid pressure chamber or said second fluid pressure chamber.

7. A variable displacement pump according to claim 3, wherein said adapter ring has a cam ring movement restriction stopper formed to be protruded partially at the inner periphery forming said first fluid pressure chamber or said second fluid pressure chamber.

8. A variable displacement pump according to claim 4, wherein said adapter ring has a cam ring movement restriction stopper formed to be protruded partially at the inner periphery forming said first fluid pressure chamber or said second fluid pressure chamber.

* * * * *